US006185978B1

(12) United States Patent
Sundgren et al.

(10) Patent No.: US 6,185,978 B1
(45) Date of Patent: Feb. 13, 2001

(54) METHOD FOR MANUFACTURING OF CURVED AND QUENCHED PROFILED ELEMENTS AND A DIE TOOL FOR CARRYING OUT THE METHOD

(75) Inventors: Anders Sundgren, Sunderbyn; Mats Lindberg, Luleå ; Göran Berglund, Gammelstad, all of (SE)

(73) Assignee: Accra Teknik AB, Ojebyn (SE)

( * ) Notice: Under 35 U.S.C. 154(b), the term of this patent shall be extended for 0 days.

(21) Appl. No.: 09/142,749

(22) PCT Filed: Mar. 4, 1997

(86) PCT No.: PCT/SE97/00374

§ 371 Date: Sep. 15, 1998

§ 102(e) Date: Sep. 15, 1998

(87) PCT Pub. No.: WO97/35039

PCT Pub. Date: Sep. 25, 1997

(30) Foreign Application Priority Data

Mar. 18, 1996 (SE) ..... 9601021

(51) Int. Cl.[7] ..... B21D 37/18

(52) U.S. Cl. ..... 72/364; 148/647

(58) Field of Search ..... 72/342.2, 342.4, 72/342.5, 364, 413, 414; 29/896.91; 148/646, 647; 226/115, 116, 117

(56) References Cited

U.S. PATENT DOCUMENTS

| | | | | |
|---|---|---|---|---|
| 1,673,564 | * | 6/1928 | Hathorn et al. | 72/413 |
| 1,682,734 | * | 9/1928 | Beans et al. | 29/896.91 |
| 1,804,792 | * | 5/1931 | Langford | 72/414 |
| 3,585,836 | * | 6/1971 | Tate et al. | 29/896.91 |
| 3,589,697 | | 6/1971 | Hays et al. . | |
| 4,057,230 | | 11/1977 | Hays et al. . | |

* cited by examiner

*Primary Examiner*—Lowell A. Larson
(74) *Attorney, Agent, or Firm*—Renner Otto, Boisselle & Sklar LLP

(57) ABSTRACT

In a method of manufacturing a curved and quenched profile element, a profile element is positioned in a die tool with relatively movable tool halves for forming the profile element into a desired curved shape. The profile element is pushed between the tool halves thereby heating the profile element to a quenching temperature and forming it into the desired curved shape. Heat is dissipated from the curved profile element at an elevated cooling device whereat a cooling liquid flows through the die tool while the profile element is still contained therewithin. The profile element is transported in a forward direction along a manufacturing path to the cooling device and is transported in the same forward direction to remove it from the cooling device thereby providing continuous mechanical handling of the profile element during the manufacturing process. The tool halves each have a facing side provided with alternating ribs and grooves so that the grooves can function as channels to lead the cooling liquid to the curved profile element.

9 Claims, 2 Drawing Sheets

Figure 1:
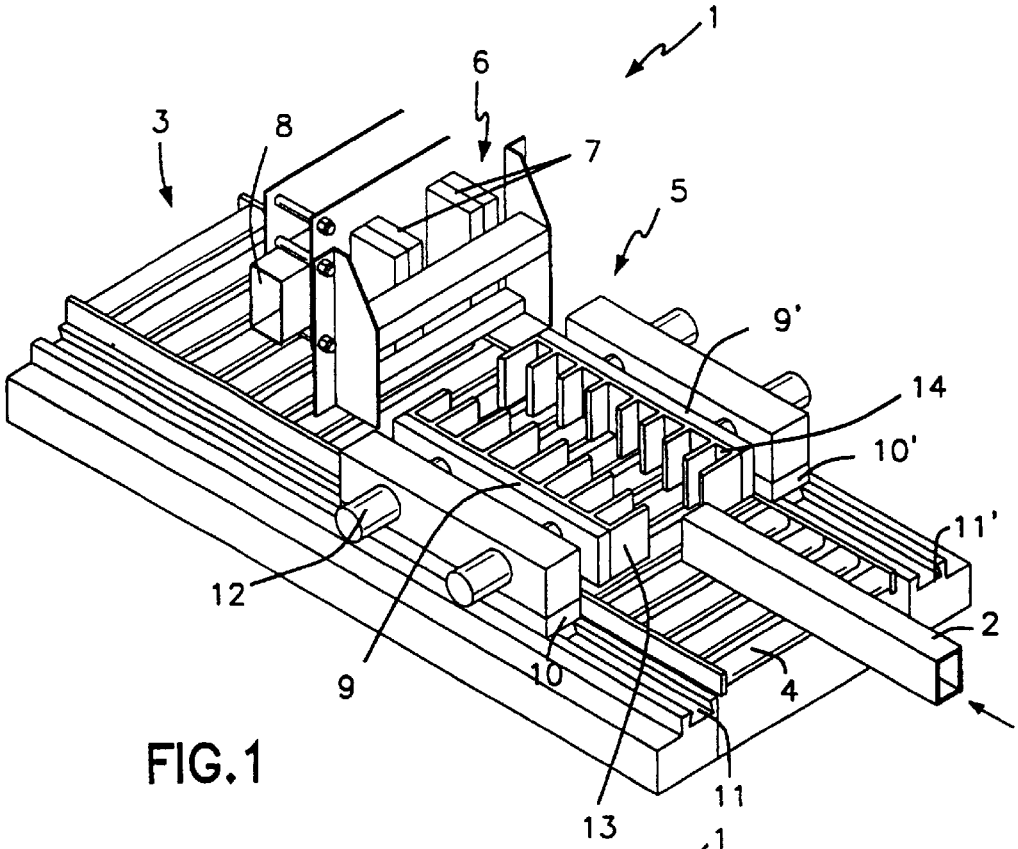

METHOD FOR MANUFACTURING OF CURVED AND QUENCHED PROFILED ELEMENTS AND A DIE TOOL FOR CARRYING OUT THE METHOD

FIELD OF THE INVENTION

The present invention relates to a manufacturing method for curved and quenched profile elements from closed profile elements, beams, or similar according to the ingressing part of claim 1 and a die tool to perform the method.

BACKGROUND OF THE INVENTION

Since a long time it is already known to form and quench workpieces out of steel. Usually this is effected in that the workpiecc is provided with the desired form by means of chosing suitable operations and suitable tools, whereafter it is heated to the quenching temperature and is to avoid form changes during the quenching process placed into a separate fixture, in which it is cooled down with a convenient speed depending on the chemical composition of the steel. Besides the unnecessarily large tool costs for two separate tools the risque for the formation of an oxide scale increases as the profile element in its heated state must be processed between these tools or fixtures.

Since a long time there existed the desire to make the production of quenched and formed products simpler and cheaper by means of both forming and quenching the product in the same tool. Thus it had especially shown to be difficult to design the press and quenching tools in a suitable way to achieve the high cooling speed, which especially for a quenching low alloy steel is totally determining to achieve a good quenching result.

As to what is already known in the art it is referred to that it is known to achieve highly resistant plate elements by means of a so-called press quenching in one and the same tool by means of of a simultaneous forming and quenching. In this method one proceeds from a low alloy plate shape to be heated to the quenching temperature, usually 800 to 950 centigrades, whereafter the shape is placed in a pressing tool provided with cooling channels and is formed while being quickly quenched by means of a cooling medium flowing in the channels. This method, however, is only adaptable for generally plane surface-like plate elements with large heat distributing surfaces and not for the present invention with closed profile elements with comparatively small heat distributing surfaces.

From U.S. Pat. No. 4,057,230 and U.S. Pat. No. 3,589,697 methods and devices are already known to quench bearing sites of crank shafts. For the fixation of crank shafts heated to the quenching temperature a sort of devices is used comprising first parts arranged at a relative distance and relatively flexible and provided with several protruding second parts, on the free ends of which recesses are provided with the object to receive and essentially circumsize the crank shaft bearing sites, when the flexible first pans arc brought together. The quenching of the crank shaft bearing sites is performed by means of several channels running through the protruding parts, the channels debouching at the periphery of said recesses for supplying and removing a cooling liquid.

Especially in the car industry there has been a demand since a long time to be able to produce curved, quenched profile elements in a simple and cheap way and from low alloy steel plate, such as posts and roof profiles to replace highly resistant material hitherto being used in the vehicle body supporting parts without renouncing the safety and the weight reduction which is always desirable, not at least for environmental reasons today.

SUMMARY OF THE INVENTION

Therefore, the object of the present invention is to simplify and to cheapen the manufacturing of closed curved and quenched profile elements in providing a new and improved manufacturing method and a die tool to perform the method. The invention provides more in detail to manufacture closed curved and quenched profile elements in one common tool for both the curving and the quenching. The manufacture of closed curved and quenched profile elements can in this way also easily be integrated into a generally existing manufacturing line for the continuous production of straight quenched closed steel profiles.

The object of the invention is achieved by means of a die tool having tool halves with facing sides provided with alternating ribs and grooves. Cooling liquid is supplied to the grooves of the tool halves thereby forming channels to the curved profile element contained with the die halves.

In providing a quenching method and a die tool with the cooling liquid supplied to the die tool with the therein contained and curved profile element and in that the cooling liquid is guided through the die tool for heat dissipation and thus making possible to manufacture with only one tool on the outside of the therein contained profile element in a conventional manufacturing line of a type which is normally and generally provided to manufacture straight quenched closed profile elements.

The invention will be described here below in connection with an embodiment with reference to the attached drawings, where

DRAWINGS

Figure 2:
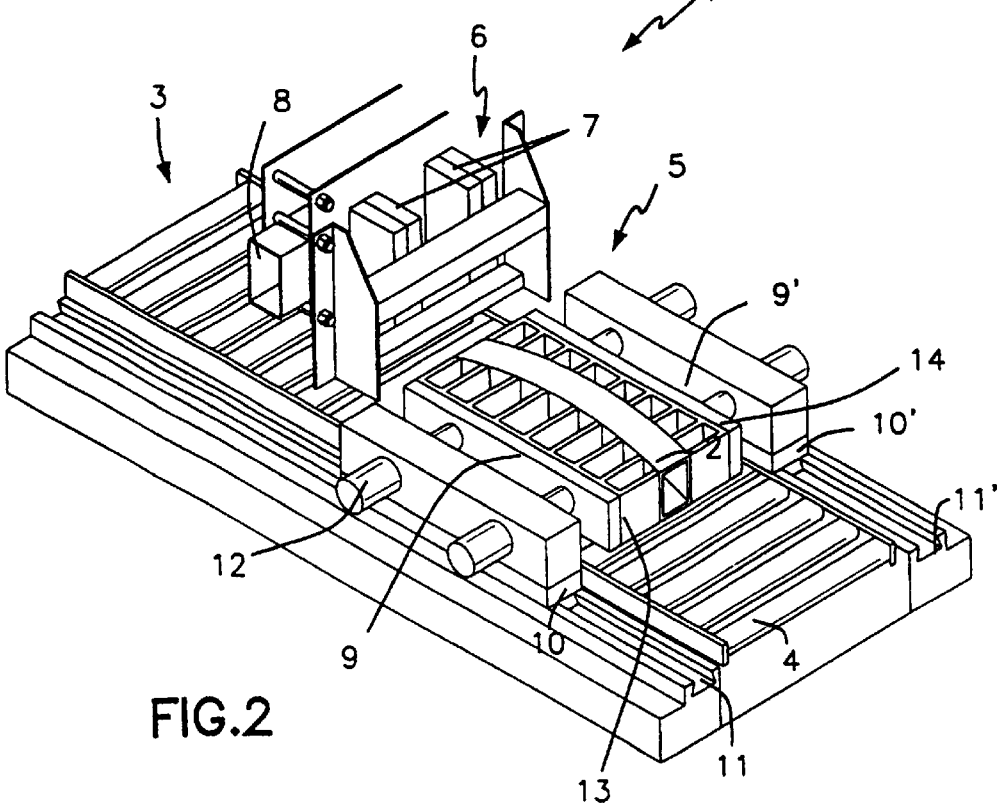
Figure 3:
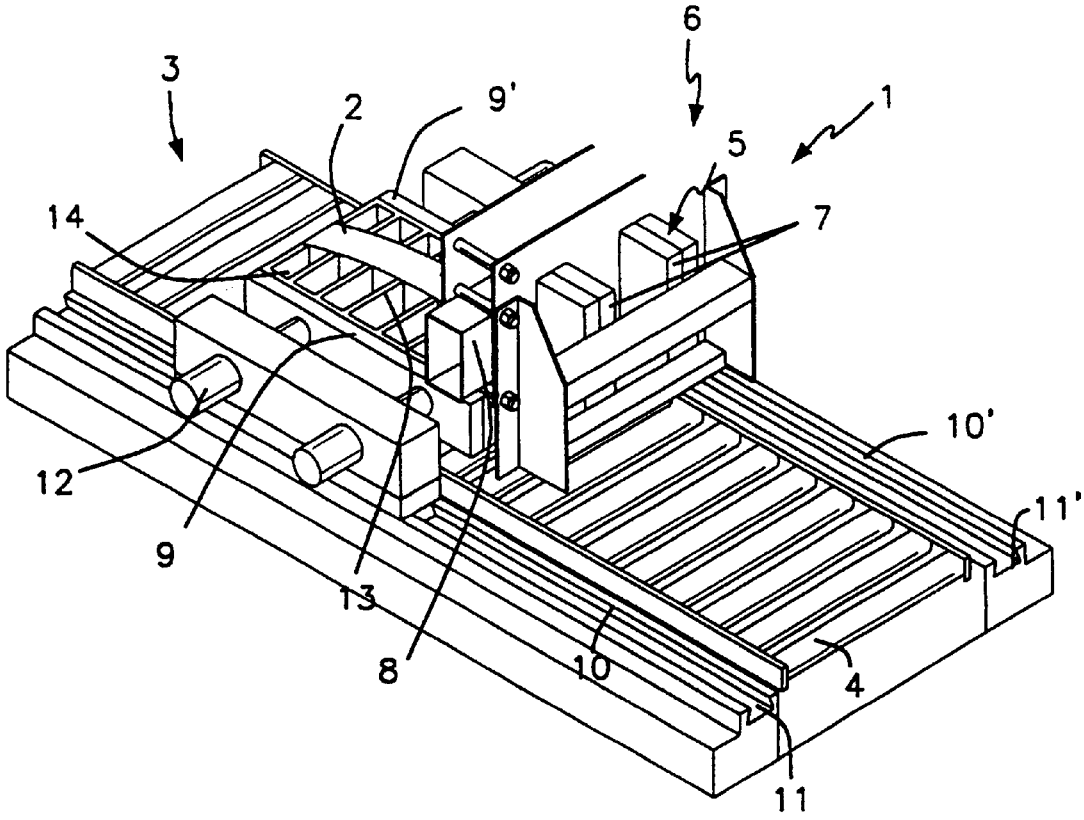
Figure 4:
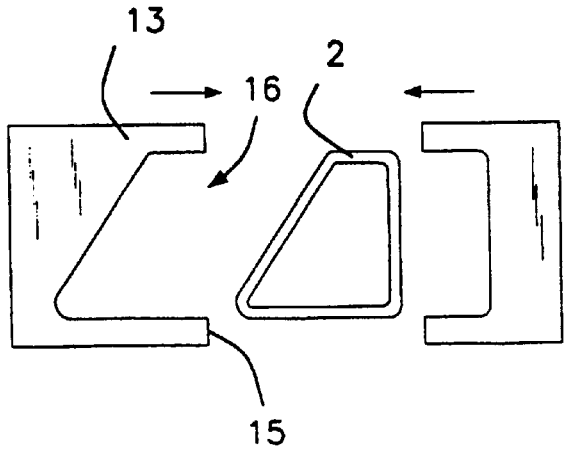

FIGS. 1 to 3 are perspective views of a part of a manufacturing line during the various steps of the manufacture of closed curved and quenched profile elements according to the method of the invention and a die tool for their manufacture, and FIG. 4 shows a side view of another embodiment of the die tool in FIGS. 1 to 3.

DETAILED DESCRIPTION

With reference to FIGS. 1 to 3 a quenching station is generally referred to as 1, comprised as a part at the end of a manufacturing line to manufacture closed curved and quenched profile elements 2 according to the invention. In the figures a portion of the path 3 is shown provided with driving rolls 4 to transport the profile elements on along the path. The quenching station comprises a die tool 5 to curve the profile elements and a cooling device 6 for the curved profile elements. The cooling device 6 comprises a showering or flushing device 7 freely supplying cooling liquid and steadily supported by means of a bracket in form of a beam 8 or similar running over the path 3.

The arriving profile element 2 in FIG. 1 is heated to the quenching temperature in a previous here not shown step. The heated profile element 2 is by means of the driving rolls 4 transported to the die tool 5 comprising two against each other movable tool halves 9, 9' for forming or curving the profile element 2, the insides of the halves provided with such a form thata profile element placed between them is provided with the desired curvature when driving the tool halves 9, 9' towards each other. To be movable along the path 3 and thereby movable to-and-fro for passing under the flushing devices 7 the tool halves are supported by means of a corresponding portal construction 10,10' guided along a guide block 11, 11' or similar running on each side of the path 3. A simultaneous reciprocating driving of said portal construction 10 and 10', respectively, is performed by means of some suitable, here not shown mechanism of an already known type, e.g. by means of a nutscrew type. In the same way the driving of the tool halves 9, 9' towards each other is performed, i.e. to curve the there inbetween placed profile element 2, by means of some suitable mecanism, e.g. by means of hydraulically operating cylinders 12 shown in the figures.

Each tool half 9, 9' is on its inside provided with reverse alternating cicrcumferential fingerlike ribs 13 and grooves 14 running continuously along said insides. The object of these ribs and grooves is to let the from the showering or flushing device 7 freely exiting cooling liquid pass the die tool 5 to dissipate the heat from the outside of the profile element 2, inspite of being all the time encased in the die tool 5. For this purpose the direction of the grooves formed on the corresponding insides of the tool halves is choosen in such a way that they run parallel to the flushing direction. With the profile element 2 encased in the die tool 5 these grooves will form channels debouching in the direction towards the showering or flushing device 7. On its way through the channels the cooling liquid passes on the outside of the encased profile element 2 and thereby dissipates heat from it.

FIGS. 2 to 3 show, how the die tool together with the there encased and curved profile element 2 is transported through the showering or flushing device 7. When the die tool 5 passes the flushing device 7 and the profile element 2 finally is quenched, the tool halves are separated to release the profile element. The die tool S may then return to its original position to be ready for the next heated profile element 2.

FIG. 4 shqws another embodiment of the die tool 5 for performing the method of the invention. In this embodiment the die tool is especially provided for curving and quenching of profile elements 2 formed unsymmetrically in cross section and thus for the manufacture of so-called double curved profile elements. For this object the free edge portions 15 of the protruding fingerlike ribs 13 are provided with recesses 16 with a profile generally corresponding to the cross section profile of the profile elements, the profile element 2 encased in the die tool being in an advantageous way supported during the curving and quenching.

It is evident that the embodiment of the invention described above and illustrated in the figures has been chosen for a better clearness to be described in its simplest form. It is of course within the scope of the invention also possible to adapt the die tool to form curved and quenched profile elements being esentially more complicated than the profile elements described above. Thus it is e.g. possible to provide the recesses 16 with such a profile that the encased profile element is not only curved in a horisontal plane, as shown in the figures, but also in a plane perpendicular to the horisontal plane. Thus, starting from a straight profile element, it is possible to achieve with the same die tool a quenched profile element with an irregular curving, such as posts and roof profiles incorporated in a vehicle body.

The method and the die tool of the present invention make it possible to use one common tool both to curve and to quench for manufacturing closed quenched and curved profile elements. Besides the tool costs to be spared in this way also the heating period of the heated profile element is reduced and thus the risque for the formation of an oxide scale. Moreover it is with the same production line and with a varying production sequence possible to manufacture both straight and curved closed and quenched profile elements.

The present invention is not limited to what has been described above and has been illustrated in the drawings, but can be altered and modified in many different wayswithin the scope of the inventive idea specified in the claims. Even if illustrated in the drawings the ribs and recesses have not to be situated at an equal relative distance, but the distance them between can of course be varied. Moreover, it is possible to arrange showering or flushing nozzles between the ribs, i.e. in the recesses, by placeing the cooling liquid channels in the tool halves.

What is claimed is:

1. A method for the manufacture of curved and quenched profile elements from closed profile elements, beams, or similar in using a die tool (5) with relatively movable tool halves (9, 9') for curving profile elements, a profile element (2) heated to the quenching temperature being pushed in between the die tool halves and is curved to a form provided by the die tool, whereafter the profile element is cooled down by means of a flushing or a showering with a cooling liquid, wherein that as a die tool (5) tool halves (9, 9') are used, being at their each other facing sides provided with facing, alternating, circumferential ribs (13) and grooves (14), the cooling liquid being supplied to the die tool (5) with the therein contained and curved profile element (2) and in that the cooling liquid is led through the die tool (5) and thereby on the outside of the therein contained profile element for dissipating heat from the profile element (2). Wherein the relatively moveable tool halves with the profile element contained therein are transported in a forward direction along manufacturing path to a cooling device prior to the cooling step and wherein the cooled profile element is transported in the forward direction to remove it from the cooling device after the cooling step.

2. A die tool for the manufacture of curved and quenched profile elements according to claim 1 of the type comprising several relatively movable tool halves (9, 9') adapted to cooperate to curve a profile element placed in the die tool (5) and between the tool halves in pushing said tool halves towards each other, wherein that each of the tool halves (9, 9') is on its inside provided with facing, alternating, circumferential ribs (13) and grooves (14) running along said insides for transporting a cooling liquid through the die tool and thus dissipating heat from the outside of the in the die tool (5) contained profile element (2).

3. A die tool according to claim 2, wherein that the direction of the grooves (14) provided inithe corresponding insides of the tool halves is chosen in such a way that they generally run parallel to the flushing direction of the cooling liquid.

4. A die tool according to claim 2, wherein that the ribs (13) are formed like fingers.

5. A die tool according to anyone of the claim 2 for curving and quenching of profile elements, wherein that the ribs (14) on their free edge portions (15) are provided with recesses (16) with a form generally corresponding to the cross section profile of the profile elements (2) encased in the die tool (5).

6. (Added) A method as set forth in claim 1, wherein the tool halves with the profile element contained therein move in the forward direction during the cooling step.

7. (Added) A method as set forth in claim 1, wherein the cooling device includes showers positioned above the manufacturing path.

8. (Added) A method of manufacturing a curved and quenched profile element, said method comprising the steps of:

positioning a profile element in a die tool with relatively movable tool halves for forming the profile element into a desired curved shape, each of the tool halves having a facing side provided with alternating ribs and grooves;

pushing the profile element between the tool halves to form a curved profile element of the desired curved shape which is heated to a quenching temperature;

transporting the relatively movable tool halves with the curved profile element contained therein in a forward direction along a manufacturing path to a cooling device;

dissipating heat from the curved profile element at the cooling device with a cooling liquid that is lead through the die tool while the curved profile element is still contained within the die tool; and transporting the cooled curved profile element in the forward direction to remove it from the cooling device.

9. A method as set forth in claim 8, wherein the cooling device includes showers positioned above the manufacturing path.

* * * * *